US005244131A

United States Patent [19]

Hollingsworth

[11] Patent Number: 5,244,131

[45] Date of Patent: Sep. 14, 1993

[54] CLOTHES MANNEQUIN GARMENT HANGER

[76] Inventor: Joseph Hollingsworth, 16115½ Eucalyptus Ave. #C, Bellflower, Calif. 90706

[21] Appl. No.: 924,522

[22] Filed: Aug. 4, 1992

[51] Int. Cl.[5] ..... A47G 25/28; A47G 25/20

[52] U.S. Cl. ..... 223/85; 223/92

[58] Field of Search ..... 223/85, 87, 92, 66, 223/68, 71, 84, 98; 211/113; D6/315, 316, 318

[56] References Cited

U.S. PATENT DOCUMENTS

| | | | |
|---|---|---|---|
| 2,099,308 | 11/1937 | McAllister | 223/98 |
| 2,265,789 | 12/1941 | Vivaudou et al. | D6/318 X |
| 2,614,736 | 10/1952 | Sarti | 223/92 |
| 2,652,957 | 9/1953 | Wolf | 223/92 |
| 3,537,625 | 11/1970 | Nuttall | 223/85 |
| 4,805,816 | 2/1989 | Freund | 223/85 |
| 4,944,417 | 7/1990 | Datlow | 223/87 X |

FOREIGN PATENT DOCUMENTS

| | | | |
|---|---|---|---|
| 2090182 | 7/1982 | United Kingdom | 223/66 |

*Primary Examiner*—Clifford D. Crowder
*Assistant Examiner*—Bibhu Mohanty
*Attorney, Agent, or Firm*—Erik M. Arnhem

[57] ABSTRACT

A clothes mannequin is formed out of a rigid flat core panel sandwiched between two surrounding layers of soft resilient foam material, such that the mannequin is relatively light weight yet resistant to bending, twisting or breaking apart. A suspension hook has a swivel connection with the core panel whereby the mannequin can be suspended from an overhead clothes bar or hook structure. In one contemplated usage of the mannequin a sleeveless smock is draped over the mannequin to hold clothing accessories, such as shoes, jewelry, scarfs, etc. in a coordinate arrangement with the clothing displayed on the mannequin.

6 Claims, 2 Drawing Sheets

CLOTHES MANNEQUIN GARMENT HANGER

BACKGROUND OF THE INVENTION

1. Field of the Invention

This invention relates to mannequins used for displaying or supporting items of clothing, e.g. dresses, sweaters, shirts, pants, shorts, etc.

2. Prior Developments

A mannequin is an upright three dimensional form having shape of a human torso. It is usually supported on a stand or pedestal, whereby items of clothing can be draped over the three dimensional object for displaying or assembling purposes.

Conventional mannequins are usually relatively heavy constructions that are not easily carried from one place to another. The present invention concerns a relatively compact light weight mannequin that can be readily moved from place to place with minimal effort.

SUMMARY OF THE INVENTION

The invention contemplates a portable mannequin formed primarily out of an elastomeric foam cushion material sandwiched around a flat rigid core panel. The panel can be formed out of corrugated fibre board or this pressed board having a thickness of about one eighth inch. The foam cushion material completely surrounds the core panel so that the mannequin surface is defined by the foam surface; the core panel is entirely concealed by the cushion material.

A suspension hook has a swivel connection with the upper edge of the core panel, so that when the hook is extended over an overhead bar or other support member the weight of the mannequin and any items of clothing draped over the mannequin are transmitted from the hook to the core panel. The foam cushion provides a light weight three dimensional body resembling a human torso; the core panel rigidifies and reinforces the elastomeric foam cushion outer layer so that the original shape of the cushion is maintained against bending, twisting or folding.

The mannequin may be used in various environments for different purposes, e.g. as a carrier for women's or men's clothing in automobiles, or as a hanger in a clothes closet for supporting clothing items in a wrinkle-free condition. Alternatively, the mannequin can be used in a clothing store for displaying clothing or for comparing different clothing combinations without the necessity for trying them on.

The mannequin preferably has a length of about twenty five inches and a width of about eighteen inches. In use, it is supported by means of a suspension hook, rather than by a pedestal-type stand, as is the conventional practice. The mannequin is thus a relatively compact, small size item, that can be suspended from a pre-existing hook structure in an automobile. It can be taken in and out of the automobile with the clothing in place on the mannequin surface. It is therefore useful as a clothes transportation device.

In preferred practice of the invention the mannequin is provided with a sleeveless smock having a number of pockets for storage of clothing accessories, such as shoes, jewelry, stockings, scarfs and handkerchiefs. Accessories color-coordinated to a particular clothing outfit can be placed in the pockets of the smock, after which the smock can be draped over the mannequin, along with the related clothing outfit. The complete outfit can then be transported as a unit and suspended in a clothes closet, e.g. in a hotel room, for ready availability to meet a special party situation.

THE DRAWINGS

FIG. 1 is taken essentially as a front view of FIG. 2.

DESCRIPTION OF A PREFERRED EMBODIMENT OF THE INVENTION

Figure 1:
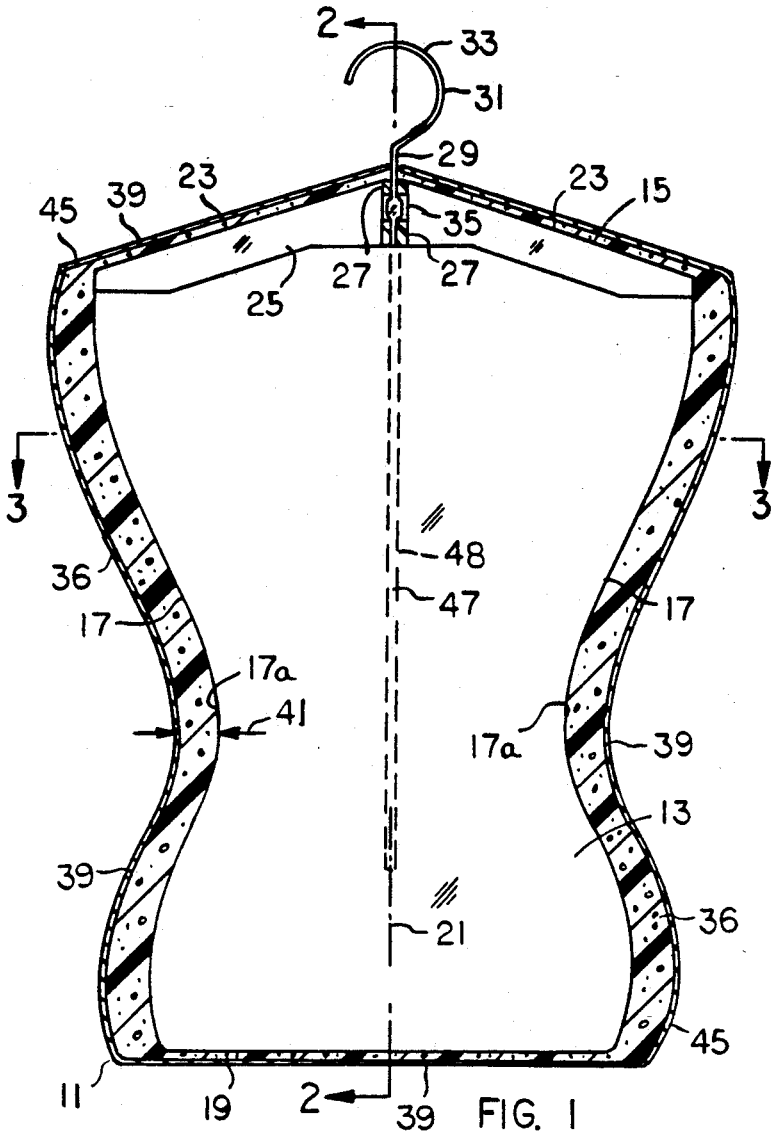
FIG. 1 is a sectional view taken through a mannequin constructed according to the invention.
Figure 2:
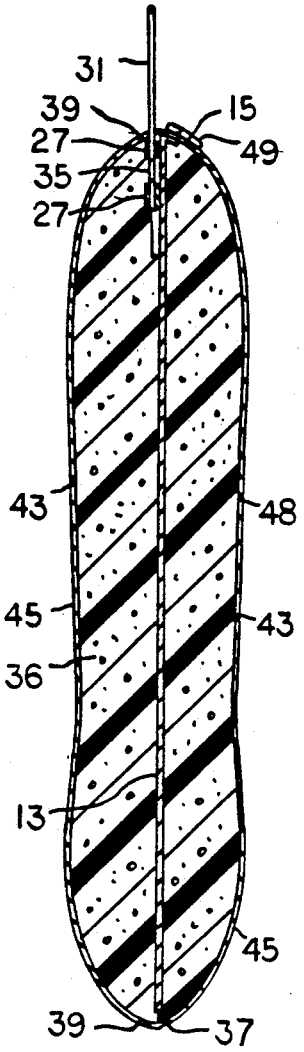
FIG. 2 is a sectional view taken on line 2—2 in FIG. 1.
Figure 3:
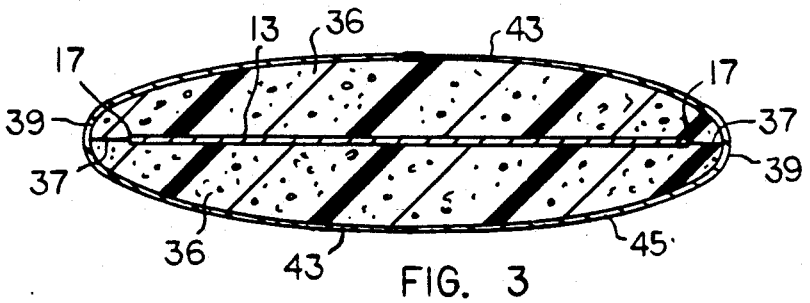
FIG. 3 is a transverse sectional view taken on line 3—3 in FIG. 1.

Referring to FIGS. 1 through 3, there is shown a clothes mannequin 11 that comprises a flat rigid core panel 13 having an upper edge 15, two side edges 17, and a lower edge 19. The panel is symmetrical around on imaginary vertical centerline 21, such that side edges 15 are mirror images of each other.

The panel upper edge 15 comprises two similar upper edge sections 23 sloping outwardly and downwardly from the vertical centerline. The slope angle is preferably about seventeen degrees. Panel 13 preferably has a thickness dimension of about one eighth inch, although the thickness dimension will vary depending on the panel material. The panel can be formed out of corrugated paperboard, or pressed board, or thin plywood having two cross grain laminations, or two thin sheets of aluminum sandwiched around a paper honeycomb layer. A prime consideration is that the panel remain flat and rigid. Another consideration is that the panel be relatively light.

Extending laterally across the upper edge of core panel 13 is a flat V-shaped strip 25, preferably formed of a light weight plastic. The strip has two sleeves 27 molded thereon at a point corresponding to the vertical centerline of panel 13. These sleeves form a vertical axis bearing for a rod portion 29 of a suspension hook 31. Hook 31 includes a curved upper rod portion 33 adapted to be hooked over an overhead bar or hook structure in a clothes closet, automobile, etc., whereby the mannequin can be suspended in a generally vertical upright position.

V-shaped strip 25 is adhesively attached to a flat surface of core panel 13 so that the upper edge of the strip coincides with the upper edge of the panel. The plastic strip reinforces the upper edge area of the panel against deformation or bending under any reasonable load forces. The plastic strip also serves as a mounting means for the bearing sleeves 27 that rotatably mount the suspension hook 31. Rod portion 29 has a flattened portion 35 that retain the hook in the bearing sleeves, whereby the suspended mannequin can swivel around the axis defined by rod portion 29.

An elastomeric foam cushion 36 completely surrounds core panel 13 and the attached strip 25. The cushion can be a rubber foam or an elastomeric plastic foam having resilience and light weight. The foam cushion could be formed as one piece, with core panel 13, strip 25, and hook 31 employed as an insert in the mold cavity for the foam cushion. However, as shown in the drawings, the foam cushion is comprised of two half sections split along a plane 37 concident with the major plane of core panel 13.

Each cushion half section is molded separately, after which the half sections are adhesively attached to the major surfaces of the core panel. Peripheral face areas of the foam half sections are bonded together along plane 37, whereby the foam cushion covers and completely encapsulates the core panel 13 and strip 25. Core panel 13 rigidifies and reinforces the foam cushion against bending, twisting or folding.

It will be seen from FIG. 1 that the outer edge surfaces 39 of the foam cushion extend essentially parallel to the edges of core panel 13. Also, the edge surfaces 39 of the cushion are in close proximity to the panel edges. The edge spacing 4 along the panel side edges 17 can be about one inch, whereas the edge spacing along the panel upper edges 15 and lower edges 19 can be about one quarter inch. The core panel thus extends across essentially the entire profile dimension of the cushion so as to provide substantial reinforcement for the soft resilient foam cushion material.

As seen in FIGS. 2 and 3, the edge surfaces 39 of the foam cushion are convexly curved so as to merge smoothly with the major surfaces 43 of the foam cushion, such that the cushion surface is continuous and smooth. This is advantageous as regards the ability of the mannequin to support articles of clothing (e.g. dresses or blouses) without wrinkling or creasing of the clothing. The major surfaces 43 of the foam cushion are spaced away from the major surfaces of core panel 13, whereby the mannequin has a three dimensional appearance, such that when clothing is draped over the mannequin the clothing will have a realistic appearance, i.e. the same general appearance as when the clothing is worn on the person. The mannequin can be used in a clothing store as a clothes display device or as a device forcomparing one clothing outfit with another (on different mannequins).

A flexible cloth cover 45 is removably fitted over and around foan cushion 36 to improve the cushion appearance, and also to provide for washability (cleanability) of the mannequin. The cloth cover is preferably formed of a cleanable woven satin material having a smooth surface; the cover will tighly fit on and around cushion 36, and will have suitable color, e.g. blue, beige, green, etc. In order to permit easy removability of the cover from around cushion 36, the cover has a zippered slot-like opening 47 extending from its upper edge vertically downwardly along the plane of centerline 21 (FIG. 1) to a point near the lower edge of the mannequin. The zipper 48 has a slider 49 that is located at the upper edge of the cover when the zipper is in its closed condition. Slider 49 is pulled downwardly along the zippered opening to open the cover for removal thereof from the mannequin. Cover 45 can be readily removed from the mannequin in order to clean the cover or replace it with a differently colored cover.

It will be seen from FIG. 1 that the aside edges 17 of core panel 13 have concave edge areas 17*a* intermediate the panel upper and lower edges. The associated edge areas 39 of cushion 36 follow the contour of edge areas 17*a*, whereby the mannequin has an hour glass profile in a direction taken normal to the major plane of core panel 13 (as viewed in FIG. 1). The hour glass configuration enables the mannequin to be used as a display device for men's or ladies' slacks. The slacks can be hung from the mid section of the mannequin torso, with a belt tightened around the slacks to hold the slacks in position on the mannequin.

The mannequin can be constructed in different sizes. However, typically, the mannequin will have a vertical length of about twenty five inches, and a horizontal width along the shoulder area of about eighteen inches; the transverse thickness normal to the plane of core panel 13 will be about four inches. The mannequin will weigh about one pound.

Figure 4:
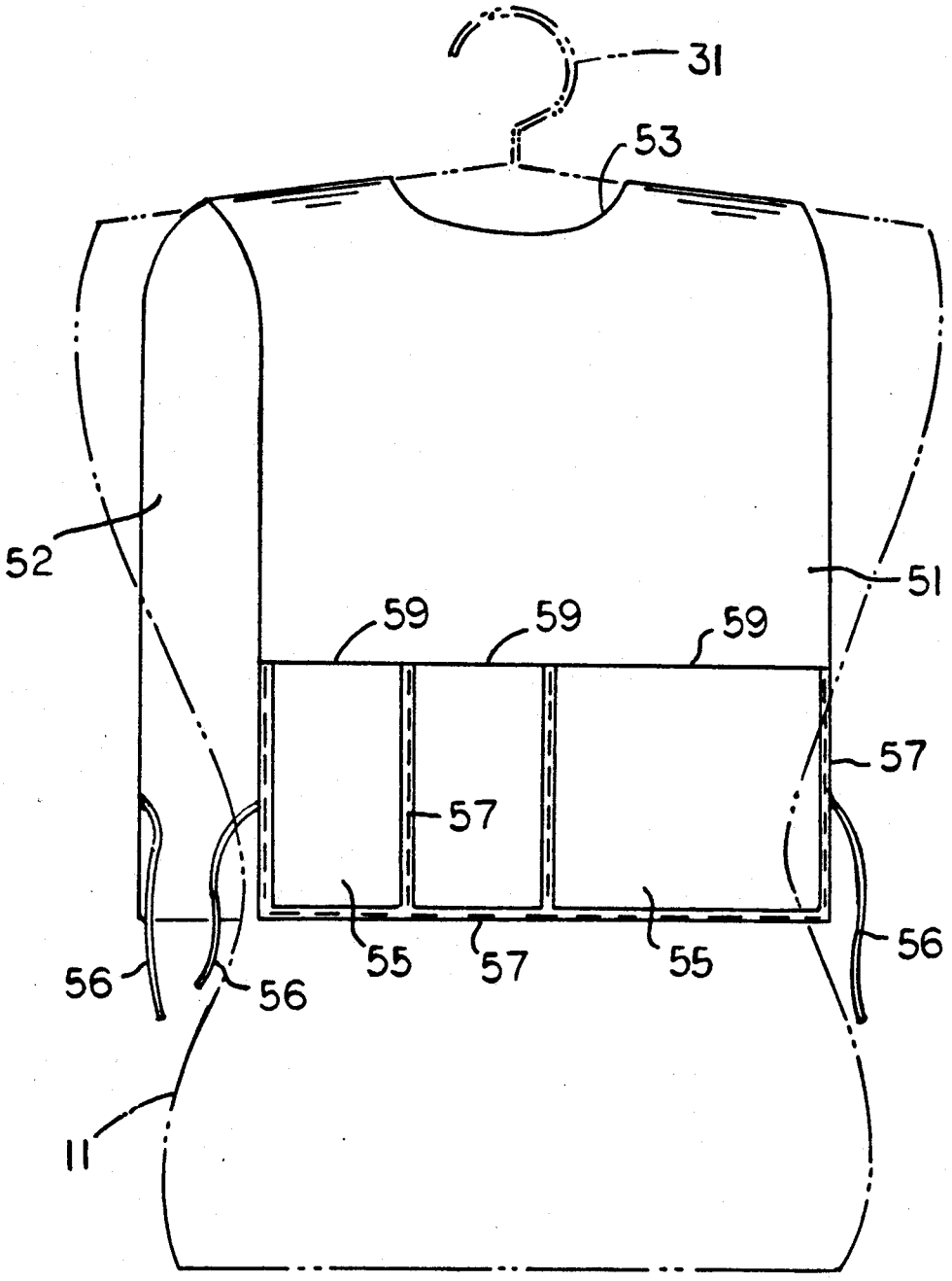
FIG. 4 is a perspective view of an accessory storage smock that can be used with the FIG. 1 mannequin. The mannequin is shown in phantom in FIG. 4.

FIG. 4 shows a clothes accessory smock that can be used with (on) the FIG. 1 mannequin. The illustrated smock comprises a front fabric panel 51 and a rear fabric panel 52 formed out of a single piece (or two pieces) of fabric. The fabric can be satin having the same color as the aforementioned fabric cover 45. The smock is sleeveless, and formed with a centrally-located circular opening 53, whereby the smock can be draped over the upper edge of the mannequin so that the suspension hook 31 extends upwardly through the circular opening. Straps 56, or equivalen connection devices, can be provided to connect the front and rear sections together on the mannequin.

A fabric panel 55 is stitched to the front section of the smock, as at 57, so as to form a plurality of upwardly open pockets 59. Clothing accessories, such as scarfs, shoes, necklaces, stockings, and bracelets color-coordinated to particular clothing ensembles can be placed in pockets 59 so as to be readily accessible when it is desired to wear the particular ensemble. The clothing item, e.g. a dress, can be draped over the mannequin, and the accessory smock placed over the clothing item. Alternately the smock can be placed on the mannequin and the clothing draped over the smock. In either case, the accessories are carried in close association with the associated clothing outfit.

The complete clothing outfit, including the clothing accessories, can be carried as a unit to or from an automobile used on a trip from one place to another. In the automobile the hook 31 (FIG. 1) can be extended over a hook or clothing bar in the rear seat area of the vehicle, such that the clothing ensemble is available for transport to a hotel room or other destination point.

The apparatus shown in FIGS. 1 through 4 can be used in stores as a device for displaying clothing in a wrinkle-free fashion. Each mannequin can be hung from a clothes bar, such that when the customer initially removes a particular item of clothing from a suspended position beneath the bar the clothing item is at once in essentially the appearance condition that it has when worn. The customer can immediately obtain a visual impression of how the clothing might look when worn.

The apparatus can also be used as a clothing carrier in an automobile. Also, the apparatus can be used by a tailor when making measurements or fittings for alteration purposes. In another environment, the apparatus can be used when it is desired to dry an item of clothing, e.g. a sweater or blouse. The clothing item hangs on the mannequin without becoming wrinkled or creased; the drying operation can thus be carried out without forming wrinkles. An ordinary coat hanger will not perform in a similar fashion.

A principal advantage of the illustrated mannequin is its light weight and low cost. An average consumer can purchase a number of the mannequins without spending an excessive amount of money.

The drawings necessarily show a specific structural configuration embodying features of the invention. However, as an example, Hook 31 may be mounted detachably similar to the ones used in hanging the conventional type garment bags. Thus, it will be appreciated that the invention can be practiced in various forms and configurations.

What is claimed:

1. A clothes mannequin comprising:

a flat rigid core panel having two major surfaces, an upper edge, two side edges, and a lower edge; said core panel having a vertical centerline located midway between its side edges; the panel upper edge comprising two upper edge sections sloping outwardly and downwardly from the vertical centerline, and said core panel being large enough to serve as a rigid reinforcement for a respective cushion;

a vertical axis bearing mounted on the upper edge area of said core panel at its vertical centerline;

a suspension hook having a downwardly-extending vertical rod portion rotatably mounted in said bearing, whereby the hook can swivel around the bearing axis;

an elastomeric foam cushion completely surrounding said core panel; said foam cushion having major surfaces and said foam cushion having an outer edge surface that extends essentially parallel to the edges of said core panel; with the outer edge surface of the cushion being in close proximity to the core panel edges; said cushion having two major surfaces spaced relatively far away from said major surfaces of said core panel, and with the outer edge surface of said cushion being convexly curved to smoothly merge with the major surfaces of the cushion to give the mannequin a three dimensional appearance, whereby articles of clothing can be arranged on the mannequin without being creased or wrinkled; and a V-shaped strip extending along the upper edge of said core panel to provide a localized reinforcement of the core panel upper edge; said bearing being integrally connected to said V-shaped strip.

2. The clothes mannequin of claim 1, wherein said foam cushion is comprised of two half sections split on the plane of the core panel; each foam cushion half section being adhesively attached to a major surface of the core panel.

3. The clothes mannequin of claim 1, wherein each side edge of the core panel includes a concave edge area spaced from the panel upper and lower edges, whereby the mannequin has an hour glass profile in a direction taken normal to the major plane of the core panel.

4. The clothes mannequin of claim 1, and further comprising a cloth cover fitting snugly around the foam cushion; said cloth cover having a zippered opening extending linearly from the upper edge vertically downwardly in a plane coincident with the vertical centerline of the core panel, whereby the cover can be removed from the foam cushion for cleaning or replacement purposes.

5. The clothes mannequin of claim 4, and further comprising a sleeveless smock adapted to be draped over the upper edge of the foam cushion and cloth cover; said smock comprising a front section having a number of pockets therein adapted to contain clothing accessories.

6. The clothes mannequin of claim 5, wherein said smock has a centrally located clearance opening adapted to accommodate the suspension hook when the smock is draped over the foam cushion.

* * * * *